US007361266B2

(12) United States Patent
Inomata et al.

(10) Patent No.: US 7,361,266 B2
(45) Date of Patent: Apr. 22, 2008

(54) METHOD OF REFINING PETROLEUM AND REFINING APPARATUS

(75) Inventors: Makoto Inomata, Higashi Ibaraki-gun (JP); Tsuyoshi Okada, Yokohama (JP); Kozo Imura, Yokohama (JP); Hajime Sasaki, Yokohama (JP)

(73) Assignee: JGC Corporation, Tokyo (JP)

( * ) Notice: Subject to any disclaimer, the term of this patent is extended or adjusted under 35 U.S.C. 154(b) by 382 days.

(21) Appl. No.: 10/507,565

(22) PCT Filed: Mar. 15, 2002

(86) PCT No.: PCT/JP02/02481

§ 371 (c)(1),
(2), (4) Date: Sep. 10, 2004

(87) PCT Pub. No.: WO03/078549

PCT Pub. Date: Sep. 25, 2003

(65) Prior Publication Data

US 2005/0155909 A1 Jul. 21, 2005

(51) Int. Cl.
*C10G 45/00* (2006.01)
*C10G 45/04* (2006.01)

(52) U.S. Cl. ..... 208/211; 208/209; 208/210; 208/208 R; 208/212; 208/213

(58) Field of Classification Search ..... 208/211, 208/208 R, 209, 210, 212, 213; 422/191
See application file for complete search history.

(56) References Cited

U.S. PATENT DOCUMENTS 4,016,067 A * 4/1977 Fischer et al. ..... 208/89
5,382,349 A * 1/1995 Yoshita et al. ..... 208/49

FOREIGN PATENT DOCUMENTS

| | | | |
|---|---|---|---|
| EP | 1130080 | A1 * | 5/2001 |
| JP | 7-82573 | A | 3/1995 |
| JP | 11-80754 | A | 3/1999 |
| JP | 2001-55585 | A | 2/2001 |

* cited by examiner

*Primary Examiner*—Glenn Caldarola
*Assistant Examiner*—John Douglas
(74) *Attorney, Agent, or Firm*—Darby & Darby PC

(57) ABSTRACT

The present invention is related to a method of subjecting a feed oil to a refining process. This method includes a fractional distillation step 1 in which a feed oil is separated into a distillate oil M1 and a bottom oil M2 by a distillation process, a separation step in which the bottom oil is separated into a bottom light oil and a residue, and a hydrorefining step 3 in which the obtained distillate oil M1 and the bottom oil M2 are subjected to hydrorefining in the presence of hydrogen and a catalyst. In the hydrorefining step 3, the bottom light oil (deasphalted oil M3) is passed through a first catalyst layer 12 of a hydrorefining unit providing a plurality of catalyst layers 12, 13, and 13 filled with a hydrorefining catalyst, and a mixed oil comprising the distillate oil M1 and the bottom light oil (deasphalted oil M3) is passed through a downstream catalyst layer 13 and subject to a hydrogenation process.

12 Claims, 6 Drawing Sheets

METHOD OF REFINING PETROLEUM AND REFINING APPARATUS

BACKGROUND OF THE INVENTION

1. Field of the Invention

The present invention relates to a refining method and refining facility for oil that efficiently recover oil products such as gasoline, kerosene, gas turbine fuel or the like, in addition to high value-added refined oils for feedstocks for petrochemistry by upgrading the crude oil, ultra heavy crude oil, bottom oil, or the like.

2. Description of the Related Art

In recent years, there has been a tendency for the global demand for oil products to decrease and the demand for electrical power to increase. Against this background, the desire to flexibly produce feedstock for fluid catalytic cracking (FCC), feedstock for hydrocracking (HCR), and gas turbine power generating fuel (GTF) from ultra heavy oil and vacuum bottom oil thereof is increasing.

However, generally in the case of refining high added-value oil products from ultra heavy crude oils such as Orinoco oil, first it must be fractioned into vacuum residue (VR) and distillate oil by a vacuum distillation process. The obtained vacuum residue is charged in a coker and subject to thermal cracking. Subsequently diene is processed by hydrogenation, then the refined oil is recovered to the extent possible by carrying out hydrodesulfurization (HDS) and hydrodenitrogenation (HDN) processes.

In contrast, the distillate oil obtained by the vacuum distillation process may be subject to a HDS process in a separate hydrogenation apparatus, but depending on the case, in order to further hydrogenation refine an inferior quality thermally cracked oil, a part of the thermally cracked oil must be subject to HDS process along with the distillate oil.

In recent years, there has been an excess of supply in the market for the bottoms of the coker (coke), and the construction of cokers that produce coke as a by-product has started to be restricted. Therefore, although an inexpensive apparatus that does not produce coke as a by-product is desired, presently the situation is that there is no such apparatus.

In addition, in processes used to upgrade ultra heavy crude oil that incorporate a coker, it is necessary to carry out complex hydrogenation (hydrogenation for incorporating diene, HDS, and HDN) of low quality thermally cracked oil and hydrorefining of the distillate oil, and thus the structure of the apparatus becomes complex. Thus, a method of recovering the refined oil using a simple apparatus is desired.

In consideration of the above, it is an object of the present invention to provide a refining method for oil that can flexibly produce oil products by a simple process without using a coker, and a refining facility suitable for implementing this method.

SUMMARY OF THE INVENTION

The refining method for oil according to a first aspect of the present invention comprises a distillation step that separates feed oil into distillate oil and bottom oil by distillation, a separating step that separates this bottom oil into bottom light oil and a residue, and a hydrorefining step in which the distillate oil and bottom light oil are subjected to hydrorefining in the presence of hydrogen. In the hydrorefining step, the bottom light oil is subject to hydrorefining by being passed through a first catalyst layer of the hydrogenation process unit that provides a plurality of catalyst layers filled with a hydrorefining catalyst, and a mixed oil comprising the distillate oil added to the bottom light oil that has been subjected to the hydrorefining passes through a downstream catalyst layer to be subject to hydrorefining.

According to this refining method, when the distillate oil and the bottom light oil having the residue removed from the feed oil is subject to hydrorefining, after the bottom light oil is subject to hydrorefining by being passed through the first catalyst layer, a mixed oil having distillate oil added is subject to a hydrogenation process by being passed through a downstream catalyst layer, and thus heat is generated by the hydrogenation process at the first catalyst layer, and distillate oil is added as a quenching oil to processed oil whose temperature has been raised, and thereby the distillate oil and bottom light oil from the feed oil having the residue removed can be efficiently subject to hydrorefining, and thus the structure of the apparatus can be simplified.

The separation step that separates the bottom oil into a bottom light oil and a residue can be an SDA step that subjects the bottom oil to solvent deasphalting to obtain a deasphalted oil (DAO), which is a bottom light oil, and asphaltene, which is the residue.

In addition, a separation step that separates the bottom oil into a bottom light oil and residue can comprise a second distillation step in which the bottom oil is separated, under a pressure being lower than that of the upstream distillation step, into a second distillate oil, which is a bottom light oil, and a second bottom oil, and an SDA step in which the second bottom oil obtained in the second distillation step is separated by solvent deasphalting into a deasphalted oil (DAO), which is a bottom light oil, and an asphaltene which is a residue.

A refining method for oil according to a second aspect of the present invention is a refining method for oil that subjects a feed oil to a refining process, and comprises a first distillation step in which a feed oil is separated into a first distillate oil and a first bottom oil by distillation, a second distillation step carried out at a lower pressure than the first distillation process to separate the bottom oil into a second distillate oil and a second bottom oil, an SDA step in which the second bottom oil is separated into a deasphalted oil (DAO) and asphaltene, which is a residue, by subjecting the second bottom oil to solvent deasphalting, and a hydrorefining step in which the first distillate oil, the second distillate oil, and the DAO are subjected to hydrorefining in the presence of hydrogen and a catalyst.

In the hydrorefining step, the second distillate oil and the DAO are subjected to hydrorefining by being passed through a first catalyst layer of the hydrogenation process unit that provides a plurality of catalyst layers that are filled with a hydrorefining catalyst, and a mixed oil comprising the first distillate oil added to the processed oil is subject to hydrorefining by being passed through a downstream catalyst layer.

The refining facility (or apparatus) for oil according to the present invention comprises a distillation unit in which feed oil is separated into distillate oil and bottom oil by distillation, a separation unit in which the bottom oil is separated into bottom light oil and residue, and a hydrorefining unit in which the distillate oil and bottom light oil are subjected to hydrorefining in the presence of hydrogen and a catalyst. The hydrorefining unit comprises a plurality of catalyst layers filled with a hydrorefining catalyst, and a quenching zone in which a part of the processed oil is supplied as a quenching material between the catalyst layers. A feed pipe for supplying the bottom light oil obtained by the separation unit is connected to the first catalyst layer, and the feed pipe for supplying the distillate oil is connected to the quenching zone.

According to this refining facility for oil, a distillate oil and bottom light oil from the feed oil having the residue removed can undergo hydrorefining in bulk, and all the feed oil can be efficiently processed by one facility.

DETAILED DESCRIPTION OF THE INVENTION

Below, the preferred embodiments of the present invention will be explained with reference to the drawings. However, the present invention is not limited by any of the following embodiments, and for example, the essential elements of these embodiments can be combined together as appropriate.

Figure 1:
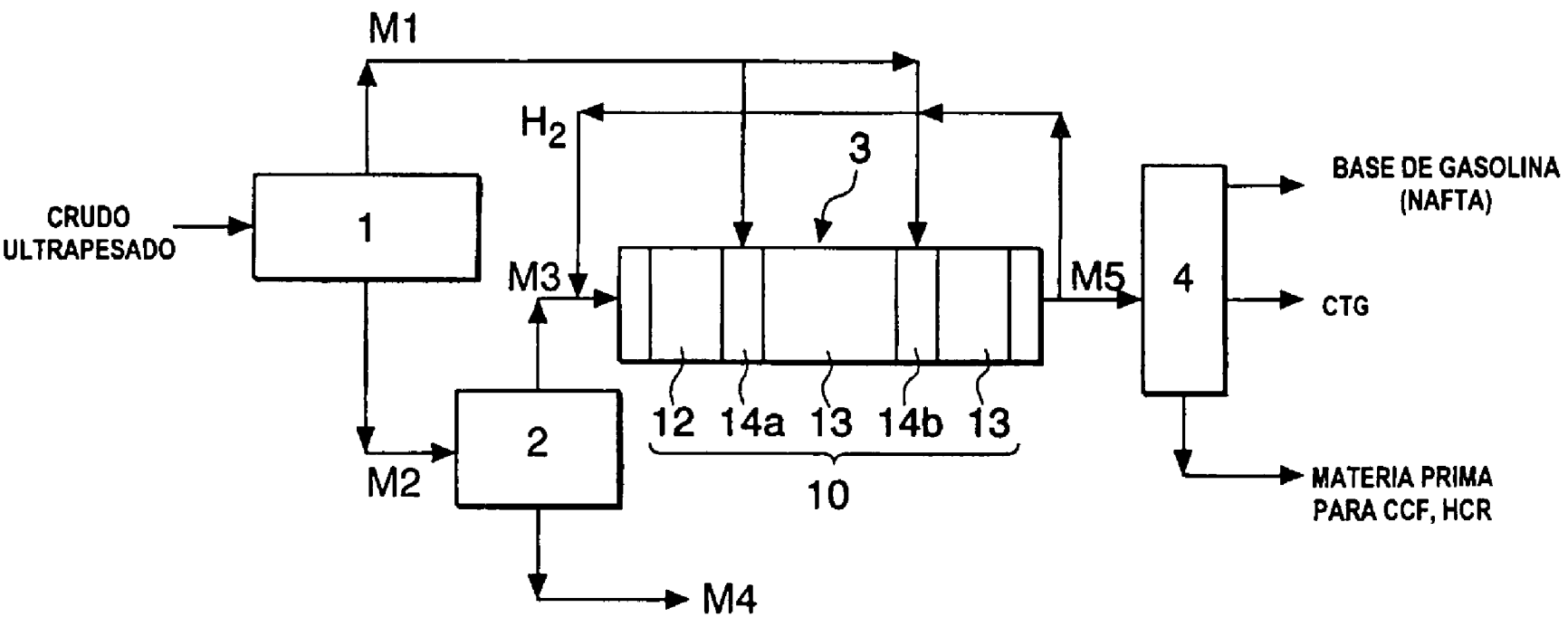
FIG. 1 is a flowchart for explaining a first embodiment of the refining method for oil according to the present invention.

FIG. 1 is a drawing for explaining the first embodiment of the refining method and refining facility (apparatus) for oil according to the present invention, and shows the process flow in the case that a plurality of oil products are manufactured from feed oil. These oil products include, for example, gasoline component (naphtha), gas turbine fuel (GTF), a feedstock for fluid catalytic cracking (FCC), and feedstock for hydrocracking (HCR).

The feed oil is not fundamentally limited, but preferably has an API gravity described below that is equal to or less than 20, and furthermore, a heavy crude oil in which the total amount of gas oil and oil lighter than the gas oil is 30 wt % or less of the whole, or more preferably a heavy crude oil in which the above amount is 20 wt % or less is used. In this embodiment, ultra heavy crude oil such as Orinoco tar is used.

The API gravity is an index for classifying oil by the physical properties, and as shown in the following equation, is a numerical value derived by its specific gravity:

$$API=(141.5/S)-131.5$$ (where $S$ is the specific gravity at 60 degrees Fahrenheit)

In the present example, first, the ultra heavy crude oil is subject to the distillation process 1, and by carrying out a distillation process similar to a conventional one, it is separated into the distillate oil M1, comprising gas oil and oil having a boiling point lower than gas oil, and the bottom oil M2, which has a boiling point higher than the gas oil. A topper, which is a typical atmospheric distillation apparatus, is preferable as an apparatus for carrying out the distillation process.

Next, the bottom oil M2 obtained in the distillation step 1 is subject to a solvent deasphalting step (SDA step) 2, and by carrying out a solvent deasphalting process, the deasphalted oil (DAO) M3 as the extracted oils, and the asphaltene M4 as the residue, are obtained.

In the deasphalting process, first the bottom oil M2 is separated into a deasphalted oil, which is the bottom light oil component, and asphaltene, which is the residue, by being brought into contact in countercurrent with the solvent in the solvent extraction column. In addition, the solvent deasphalted oil is recovered along with solvent from the top of the solvent extraction column, the solvent in the recovered material is removed by evaporation or the like under supercritical conditions, and the solvent deasphalted oil is obtained. In contract, the asphaltene is recovered at the bottom of the column, the solvent in the recovered material is removed by evaporation or the like, and asphaltene is obtained.

After the solvent deasphalting step 2, the obtained deasphalted oil M3 is subject to a hydrorefining step (HDMS step) 3, is then subject to hydrodemetalizing (HDM) in the presence of hydrogen and a catalyst, and is finally subject to HDS and HDN processes along with the distillate oil M1 obtained in the distillation step 1 to obtain the processed oil M5.

Figure 2:
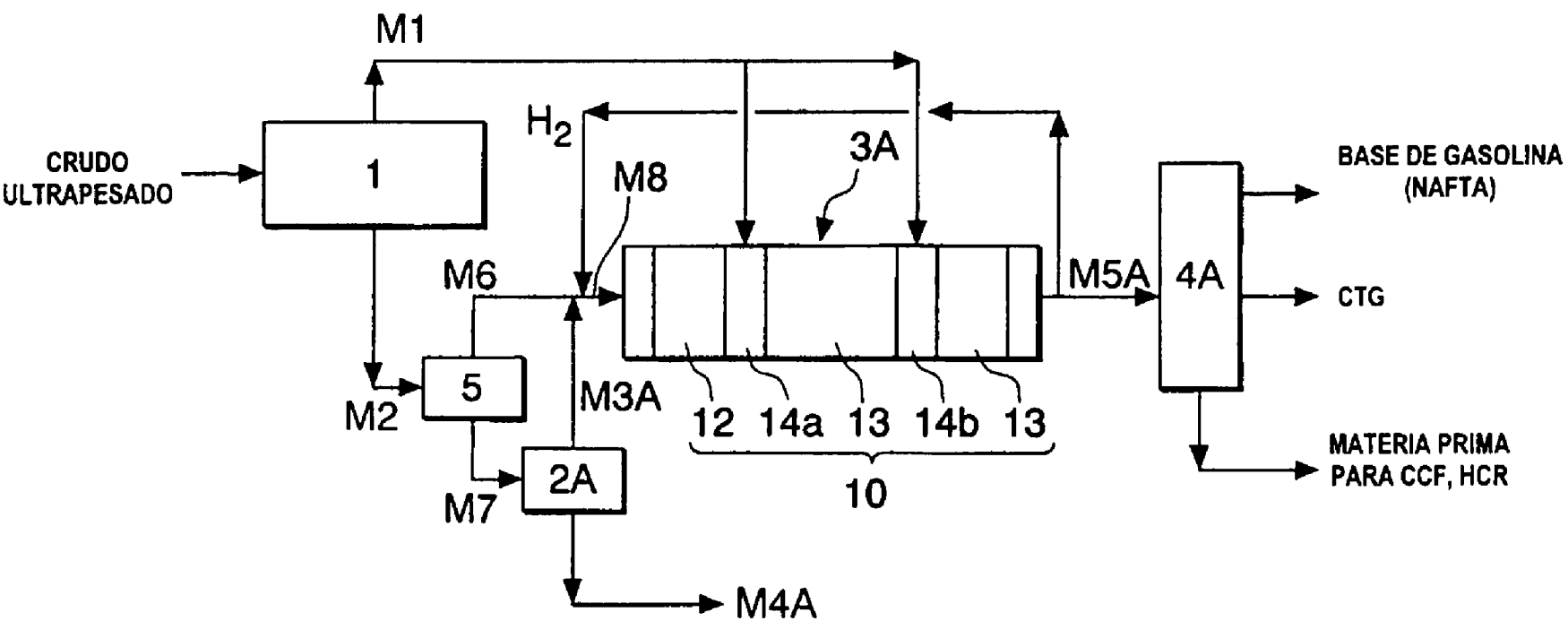
FIG. 2 is a flowchart for explaining a second embodiment of the refining method for oil according to the present invention.

FIG. 2 is a drawing for explaining a second embodiment of the present invention, and this embodiment differs from the previous embodiment on the point that before the bottom oil M2 obtained in the distillation step 1 described above is supplied to the solvent deasphalting step 2, a further stage of fractional distillation is carried out.

Specifically, in this embodiment, by separating the bottom oil M2 into the vacuum gas oil M6 and the vacuum bottom oil M7 by vacuum distillation as a second distillation step 5, the obtained vacuum bottom oil M7 is supplied to the solvent deasphalting step 2A, the deasphalted oil M3A and the asphaltene M4A, which is the residue, are obtained, a bottom light oil M8 is obtained by mixing the deasphalted oil M3A and the vacuum gas oil M6, and this bottom light oil M8 is supplied to the hydrorefining step 3A.

The bottom light oil M8 obtained by this embodiment is a mixture of the vacuum gas oil M6 obtained by the vacuum distillation step 5 and the deasphalted oil M3A obtained by the solvent deasphalting step 2A. This bottom light oil M8 is subject to a hydrorefining step 3A, and like the deasphalted oil M3 in the first embodiment, after HDM in the presence of hydrogen and a catalyst, it is subject to a HDS process and HDN process along with the distillate oil M1 obtained by the distillation step 1 to obtain the processed oil M5A.

Figure 3:
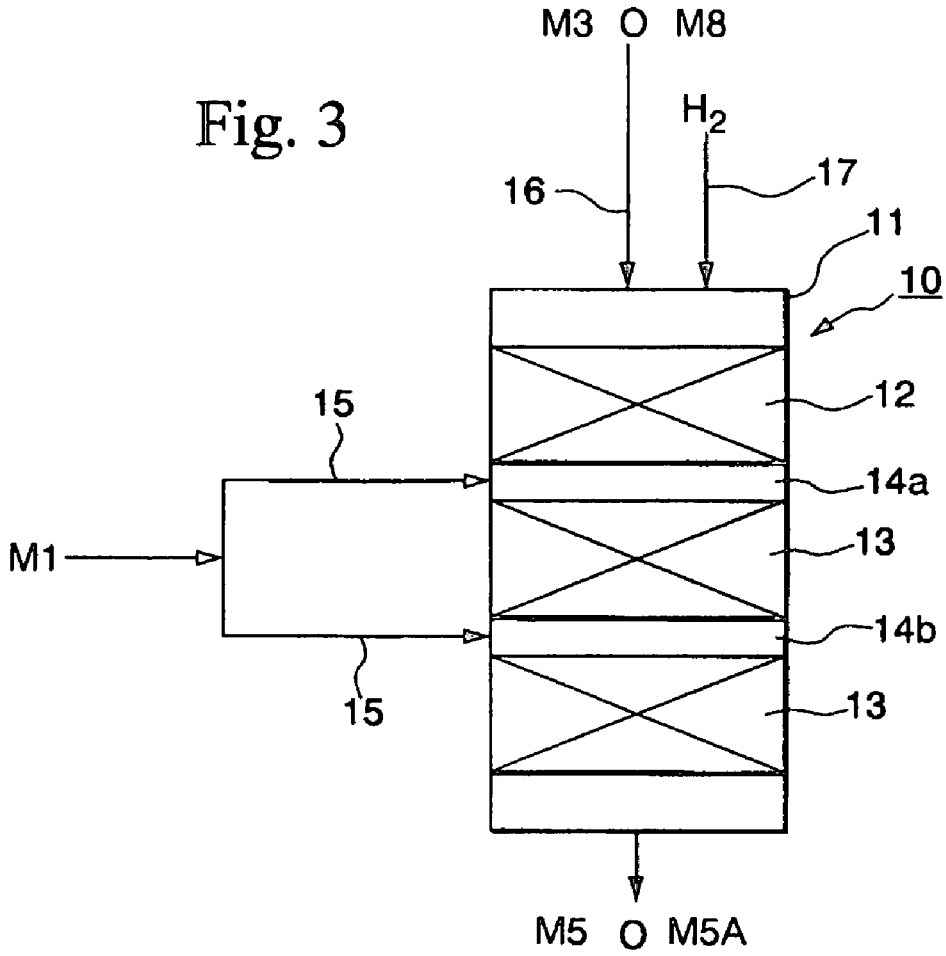
FIG. 3 is a schematic diagram for explaining the first embodiment of the refining facility for oil according to the present invention.

In both the first and second embodiments, the hydrorefining process can be carried out by using the refining device 10 shown in FIG. 3.

The refining device 10 comprises the essential components of the embodiments of the refining facility for oil according to the present invention. The refining device 10 comprises a plurality of catalyst layers that are filled with a hydrorefining catalyst through which the processed oil passes, and has a quenching zone to which a part of the processed oil that has been subjected to hydrorefining is supplied between the catalyst layers as quenching oil. In the refining device 10, the bottom light oil obtained from the bottom oil M2 as the processed oil is subject to a HDM process in the presence of hydrogen and a catalyst, and then is subject to a HDS process and a HDN process along with the distillate oil M1. The refining device 10 provides one HDM catalyst layer 12 for HDM in the reactor body 11 and two HDS catalyst layers 13 for the HDS and HDN processes. Furthermore, between these three layers, the respective quenching zones 14*a* and 14*b* are provided. Moreover, in the present embodiment, the HDM catalyst layer 12 is the first catalyst layer, and the HDS catalyst layer 13 is the downstream catalyst layer. The HDM catalyst layer 12 and the HDS catalyst layer 13 can be either on a fixed bed or a moving bed.

The HDM catalyst that fills the HDM catalyst layer 12 has a HDM capacity and a HDS capacity, is a catalyst that has a relatively high HDM activity, and in the case that the processed oil is brought into contact with the HDM catalyst under high temperature, high pressure, and in the presence of hydrogen, generally has the capacity to absorb the metal components such as vanadium, nickel, and the like included in the processed oil.

The HDS catalyst that fills the HDS catalyst layers 13 has a HDS capacity and a HDM capacity, is a catalyst having a relatively high HDS activity, and in the case that the processed oil is brought into contact with the HDS catalyst under high temperature, high pressure, and in the presence of hydrogen, generally has the capacity to convert the sulfur component and nitrogen component included in the processed oil into hydrogen sulfide and ammonia.

For the HDM catalyst, alumina or a silica alumina can act as the carrier, Mo can serve as the main component in the active metal, and metals such as Ni, Co, W or the like can be incorporated. In order to provide a large metal absorbance capacity, preferably the average pore diameter is 20 to 200 nm, the pore volume is 0.7 to 1.2 $cm^3/g$, and the surface area 80 to 180 $m^2/g$. Ni—Mo and Ni—Co—Mo catalysts are typical.

For the HDS catalyst, like the HDM catalyst, alumina or silica alumina can act as the carriers, Mo can serve as the main component of the active metal, and metals such as Ni, Co, or W or the like can be incorporated. Compared to a HDM catalyst, it is characterized in that the contact surface area is large, and preferably the average pore diameter is 8 to 12 nm, the pore volume is 0.4 to 0.7 $cm^3/g$, and the surface area is 180 to 250 $m^2/g$. Ni—Mo, Ni—Co—Mo, and Co—Mo catalysts are typical.

The shape of these catalysts can be square or round columns, spheres, or the like, and is not particularly limited. The size of these catalysts is not particularly limited either, but the particle diameter of the HDM catalyst is preferably approximately 6 to 1.2 mm, and the particle diameter of the HDS catalyst is preferably approximately 1.6 to 0.8 mm.

The volume ratio (HDM catalyst/HDS catalyst) of the HDM catalyst and HDS catalyst that fill the refining device 10 is preferably 5/95 to 40/60, and more preferably 10/90 to 30/70. Because the HDS catalyst carries out the desulfurizing of the distillate oil M1 added as a quenching oil, described below, preferably the amount of the HDS catalyst should be larger than the HDM catalyst.

A distillate oil line 15 that supplies the distillate oil M1 obtained by the distillation step 1 is connected to the quenching zones 14*a* and 14*b*, and thereby the distillate oil M1 is added and mixed to the oil after each process as quenching oil. In addition, a mixer is disposed in the quenching zones 14*a* and 14*b* so that the mixing of the oil after the processing with the quenching oil is carried out sufficiently, and thereby the mixing of the oil and quenching oil after the processing and the heat exchange are carried out smoothly.

Due to having this type of structure, the oil after each process is cooled by the distillate oil M1 serving as the quenching oil by an amount equivalent to the temperature increase due to heating during the HDM process and the HDS process, and then guided to the downstream catalyst layer.

To carry out a hydrorefining process on the bottom light oils (M3 or M8) obtained from the bottom oil M2 by the refining device 10, the bottom light oil is guided to the HDM catalyst layer 12 in the refining device 10 by the feed line 16, and at the same time, the hydrogen is introduced into the HDM catalyst layer by the hydrogen feed line 17, and here, the main HDM process is carried out.

As conditions for the refining process in the refining device 10, the ratio (hydrogen/oil) of hydrogen to bottom light oil introduced is preferably 200 to 1000 $Nm^3/k1$, and more preferably 400 to 800 $Nm^3/k1$. When the proportion of hydrogen falls below this range, there are the concerns that the efficiency of the HDM reaction and the HDS reaction in the HDM catalyst layer 12 and the HDS catalyst layer 13 will deteriorate, HDM and HDS cannot be carried out sufficiently, coke deposition will accelerate, and the catalyst life will become short. In addition, when the proportion of hydrogen exceeds the range described above, the cost may increase.

The partial pressure of the hydrogen is preferably 60 to 200 kg/cm , and more preferably 80 to 150 $kg/cm^2$. When the partial pressure falls below this range, the efficiency of the HDM reaction and the HDS reaction of the HDM catalyst layer 12 and the HDS catalyst layer 13 deteriorates, HDM and HDS cannot be carried out sufficiently, coke deposition will accelerate, and the catalyst life will become short. In addition, when the partial pressure of the hydrogen exceeds the range described above, the process cost may increase.

The process temperature is preferably between 350 and 450° C., and more preferably between 370 and 430° C. When the temperature falls below this range, the efficiency of the HDM reaction and the HDS reaction of the HDM catalyst layer 12 and the HDS catalyst layer 13 deteriorates, HDM and HDS cannot be carried out sufficiently. In addition, when the temperature exceeds the range described above, there are the concerns that the yield will decrease due to the decomposition of the bottom light oil, the quality will be compromised, coke deposition will accelerate, and the catalyst life will become short.

Under such conditions, the bottom light oil is subject to the HDM process in the HDM catalyst layer 12 in the presence of hydrogen and a HDM catalyst, and the HDM processed oil whose temperature has been raised due to the heat generated during the process flows into the quenching zone 14*a*. The distillated oil M1 obtained in the distillation step 1 is supplied to the quenching zone 14*a* via the distillation oil line 15. Thereby, the HDM processed oil having the raised temperature after the HDM process is cooled by adding and mixing the distillate oil M1, and in this state, it is guided to the first layer of the HDS catalyst layer 13. Moreover, in order to cool the HDM processed oil to the desired temperature, preferably an appropriate temperature adjustment of the distillate oil M1 supplied to the quenching zone 14*a* is carried out in advance so that the HDM processed oil attains an optimal temperature.

The mixture of the HDM processed oil and the distillate oil M1 that has been guided to the first HDS catalyst layer 13 is subject to a HDS process in the presence of hydrogen and a HDS catalyst and this mixture, whose temperature has been increased due to the heat generated during this process, is introduced into the quenching zone 14*b*. The distillate oil M1 obtained by the distillation step 1 is also supplied to the quenching zone 14*b* via the distillate oil line 15. Therefore, the processed oil having an increased temperature after the HDS process is cooled by being added and mixed with the distillate oil M1, and in this state, guided to the second HDS catalyst layer 13.

The HDS processed oil guided to the second HDS catalyst layer 13 is subject to the HDS process in the presence of hydrogen and a HDS catalyst similar to the first HDS catalyst layer 13, and subsequently as has been described above, the processed oils (M5 or M5A) are guided out from the refining device 10.

The distillate oil M1 obtained from the distillation process can be divided into two parts which are respectively supplied to the quenching zone 14*a* and the quenching zone 14*b*. Here, the amount of each of the supplies can be adjusted to an appropriate portion by taking into consideration the amount of heat generated by each part. Specifically, the temperature of the mixture of the processed oil and the distillate oil M1 (quenching oil) passing through each of the quenching zones 14*a* and 14*b* is preferably adjusted so as to be the same as the temperature of the entrance to the next catalyst layer that this mixture will pass through.

In either of the first or second embodiments, the processed oils M5 or M5A that have been subject to the refining process by the refining device 10 are next subject to a rectification process in the rectification step 4 shown in FIG. 1 or the rectification step 4A shown in FIG. 2. Pluralities of oil products are produced together. Examples of these oil products are transportation fuel, gas turbine fuel (GTF), and feedstock for fluid catalytic cracking (FCC) or a feedstock for hydrocracking (HCR).

The rectification process can be carried out in a conventionally known typically rectification column, and in addition, conditions identical to conventional rectification can be used for the conditions for obtaining each of the oil products.

In each of the embodiments shown in FIG. 1 and FIG. 2, gasoline component (naphtha), gas turbine fuel (GTF), and feedstock for fluid catalytic cracking (FCC) or a feedstock for hydrocracking (HCR) are produced together as oil products, but the invention is not limited thereby.

Figure 4A:
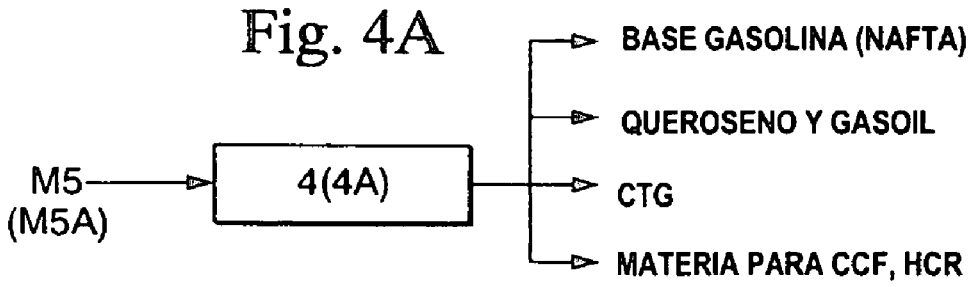
FIG. 4A and FIG. 4B are both drawings for explaining the rectification method.

For example, as shown in FIG. 4A, in the rectification step 4 (or 4A) gasoline component (naphtha), kerosene and gas oil, gas turbine fuel (GTF), and the feedstock for fluid catalytic cracking (FCC) and the feedstock for hydrocracking (HCR) can be produced together.

Figure 4B:
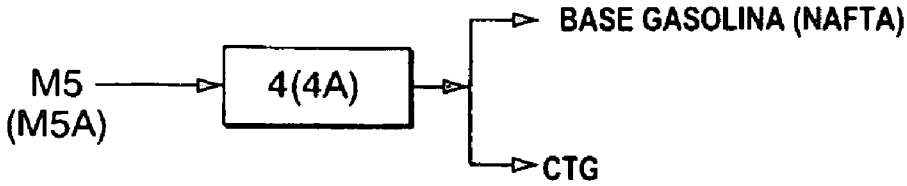

In addition, as shown in FIG. 4B, in the rectification step 4 (or 4A), after distilling the gasoline component (naphtha), all of the oil in the column component can be used for gas turbine fuel, and thereby only gasoline component (naphtha) and gas turbine fuel can be produced together.

The hydrogen guided along with the processed oil M5 from the refining device 10 is vapor-liquid separated under high pressure before being guided to the rectifications column, recovered, and circulated in the refining device 10 for the oil again.

According to this type of refining method for oil, when the HDM process and the HDS process are carried out in the hydrorefining step (3 or 3A) on the bottom light oil (M3 or M8) obtained from the bottom oil M2, the distillate oil M1 obtained by the distillation process is used by being added as a quenching oil, and thus a plurality of oil products can be produced together by rectifying the obtained processed oil (M5 or M5A).

In addition, the distillate oil M1 is added as quenching oil to the HDM processed oil whose temperature has been increased due to the heat generated during the HDM process, and thus a simple process structure that does not use a coker is realized, and the structure for implementing hydrorefining step can be implemented.

In addition, in the case that a heavy oil having an API gravity equal to or less than 20 is used as the feed oil, generally the total weight of the gas oil and the oil lighter than the gas oil is equal to or less than 30 wt %, and therefore the total weight of the bottom light oil obtained by the present invention can be refined by one hydrorefining reactor, the process is simple, and the apparatus cost is inexpensive.

In addition, in the refining device 10 in FIG. 3, one HDM catalyst layer 12 for the HDM process and two HDS catalyst layers 13 for the HDS process are provided, and between these catalyst layers, the quenching zones 14*a* and 14*b* to which the quenching oil is supplied in order to cool the processed oil are provided, and thus by using the distillate oil M1 obtained by the distillation process as a quenching oil, the HDM processed oil whose temperature has been raised due to the heat generated during the HDM process can be cooled, and furthermore, the obtained processed oil can be desulfurized in bulk. Therefore, pluralities of oil products can be produced together by distilling this. In addition, because the structure does not use a coker, the apparatus structure can be simple.

Moreover, in this embodiment, the distillate oil M1 is added as a quenching oil, but the object of the present invention is not limited to cooling, and includes all methods in which a processed oil is added after a second catalyst layer.

In addition, in this embodiment, pluralities of types of oil products were produced together by providing a rectification process after the hydrorefining step, but the present invention is not limited thereby, and without providing the rectifying step, the processed oil obtained by the hydrorefining step can be made into direct oil products or intermediate oil products.

In addition, the refining device 10 used in this embodiment provided one HDM catalyst layer 12 and two HDS catalyst layers 13, the present invention is not limited thereby, and one layer each of the HDM catalyst layer 12 and the HDS catalyst layer 13 may be provided, or the HDM catalyst layer 12 can be provided in plurality and one HDS catalyst layer 13 provided, or both may be allotted a plurality of layers.

Figure 5:
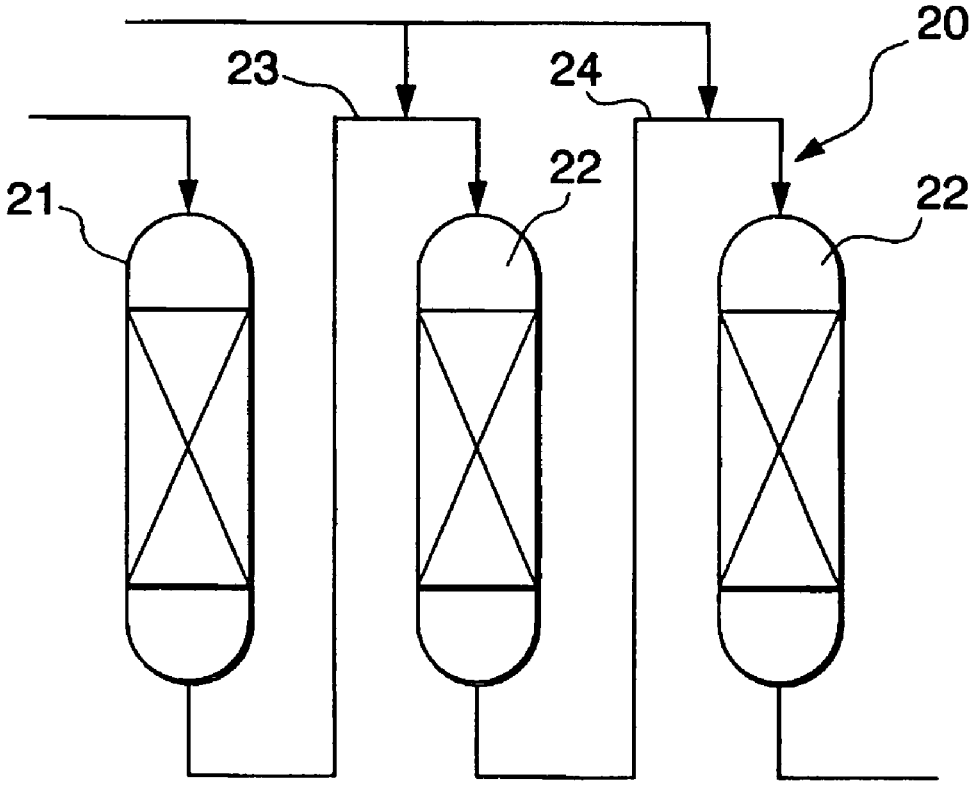
FIG. 5 is a schematic drawing showing the second embodiment of the refining facility for oil according to the present invention.

In addition, in each of the embodiments, as shown in FIG. 3, a refining facility for oil providing a plurality of catalyst layers in the reactor of one column was used, but for example, in the case that the amount to be processed is large, as shown in FIG. 5, a reactor comprising a plurality of columns can be used.

The refining facility 20 shown in FIG. 5 has three reactors. The first reactor is a HDM reactor 21, and therein a HDM catalyst layer (not illustrated) is provided. In addition, the second and third reactors are both HDS reactors 22, and a HDS catalyst layer is provided in each.

Piping connects these reactors 21, 22, and 23, and the piping between the reactors serves as a quenching zone. That is, the piping 23 between the first HDM reactor 21 and the second HDS reactor 22 and the piping 24 between the second HDS reactor 22 and the third HDS reactor 22 each serve as quenching zones. The distillate oil M1 that serves as the quenching oil is supplied respectively to these pipes 23 and 24.

In this type of refining facility 20 as well, effects identical to those of the refining device 10 can be obtained.

EXAMPLES

Below, the present invention will be concretely explained using examples.

Example 1

Figure 6:
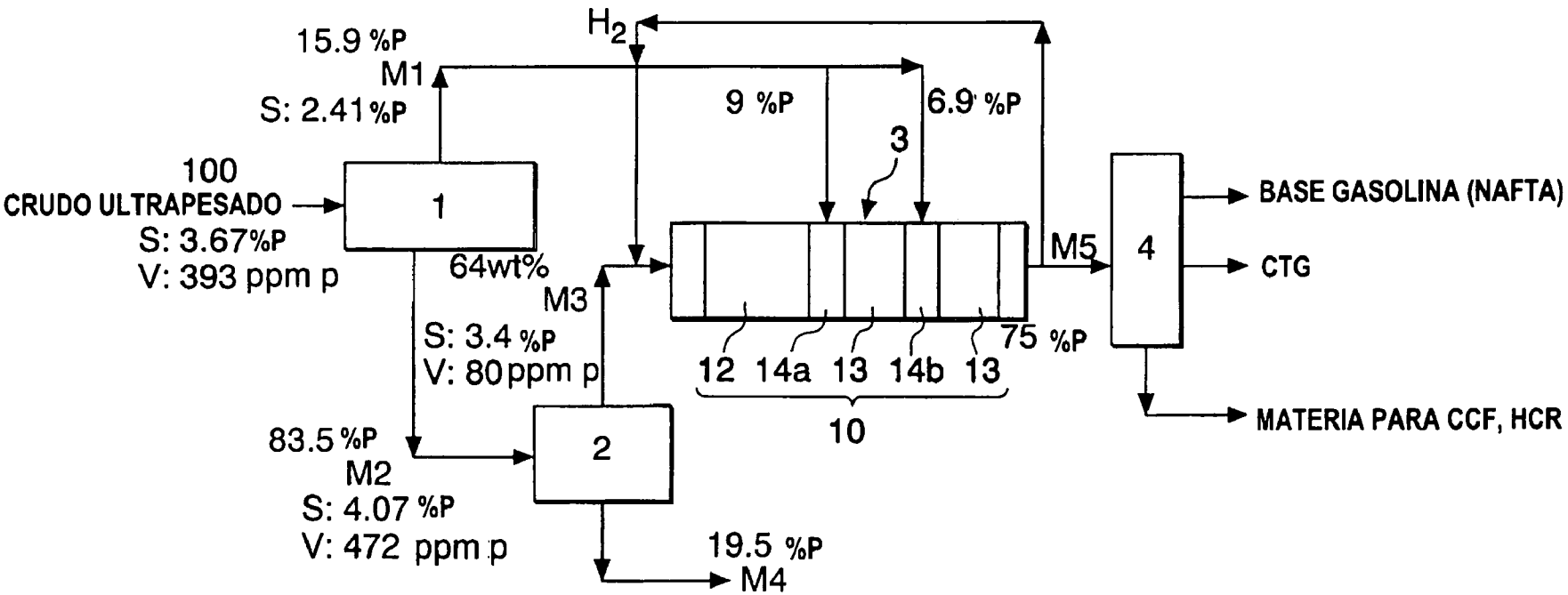
FIG. 6 is a flow chart showing the first embodiment of the refining method for oil according to the present invention.

Based on the refining method for oil shown in FIG. 1, naphtha (gasoline component), GTF (gas turbine fuel), the feedstock for FCC (fluid catalytic cracking), and the feedstock for HCR (hydrocracking) were produced as shown in FIG. 6.

As a feed oil, an ultra heavy crude oil having an API gravity of 8.5, a sulfur concentration of 3.67 wt %, and a vanadium concentration of 393 wtppm was used. This feed oil was subject to a distillation process in a topper (distillation step 1) to obtain a distillate oil 1 and a bottom oil 2.

The yield of the distillate oil M1 from the feed oil was 15.9 wt %, and the sulfur concentration was 2.41 wt %. The yield of the bottom oil M2 from the feed oil was 83.5 wt %, the sulfur concentration was 4.07 wt %, and the vanadium concentration was 472 wtppm.

Next, the bottom oil M2 was subject to a solvent deasphalting process (solvent deasphalting step 2) in the solvent extraction column using pentane as a solvent, and at an extraction rate of 76.6%, a deasphalted oil M3 was obtained, and at the same time the asphaltene M4, which was the residue, was obtained. The ratio (solvent/M2) of solvent to bottom oil M2 in the solvent deasphalting process was 8. The yield of the obtained deasphalted oil M3 from the feed oil was 64 wt %, the sulfur concentration was 3.4 wt %, and the vanadium concentration was 80 wtppm. The yield of the asphaltene M4 from the feed oil was 19.5 wt %.

Next, the obtained deasphalted oil M3 was guided to the refining device 10 shown in FIG. 3, and HDM and HDS were respectively carried out in the HDM catalyst layer 12 and the HDS catalyst layers 13 and 13. At the same time, distillate oil M1 was supplied to each of the quenching zones 14*a* and 14*b* to obtain the processed oil M5. The volume ratio of the HDM catalyst to HDS catalyst that fill the refining device 10 was 3:7.

Among other conditions, the hydrogen partial pressure was 100 atm, the ($H_2$/oil) ratio was 600N1/1, the LHSV was 0.5/hr, and the reaction temperature was 370° C. The yield of the obtained processed oil M5 from the feed oil was 75 wt %, the sulfur concentration was 0.32 wt %, and the vanadium concentration was 0.72 wtppm.

The amount of distillate oil M1 supplied to the quenching zones 14*a* and 14*b* was adjusted so that the temperature of the mixture of the processed oil and the distillate oil M1 (quenching oil) passing through each of the quenching zones 14*a* and 14*b* was equivalent to the temperature of the entrance of the catalyst layer that the mixture would pass through next.

Next, the processed oil M5 obtained by the refining device 10 is guided to the rectifying column, and a rectification process (rectifying step 4) is carried out. The rectification process (rectifying stage 4) is carried out according to the following two methods.

Method 1: fractioning into a naphtha fraction (boiling point of 180° C. or less), GTF (boiling point between 180 and 400° C.), and an FCC feedstock or an HCR feedstock (boiling point 400° C. or greater).

Method 2: after the same process as Method 1, 13 wt % (with respect to the crude oil) of the obtained FCC feedstock or HCR feedstock are fractioned to make GTF.

The yield, amount of included sulfur, and the amount of included vanadium in the naphtha fraction, the GTF (gas turbine fuel), the feedstock for FCC (fluid catalytic cracking), and the feedstock for HCR (hydrocracking) were measured. The results are shown in the following Table 1 and Table 2.

TABLE 1

(rectification process: Method 1)

| | Yield from crude oil(wt %) | S (wt %) | V (wtppm) |
|---|---|---|---|
| Naphtha fraction | 2 | — | — |
| GTF | 13 | 0.02 | 0 |
| FCC feedstock or HCR feedstock | 60 | 0.4 | 0.9 |

TABLE 2

(rectification process: Method 2)

| | Yield from crude oil(wt %) | S (wt %) | V (wtppm) |
|---|---|---|---|
| Naphtha fraction | 2 | — | — |
| GTF | 26 | 0.21 | 0.45 |
| FCC feedstock or HCR feedstock | 47 | 0.4 | 0.9 |

Example 2

Figure 7:
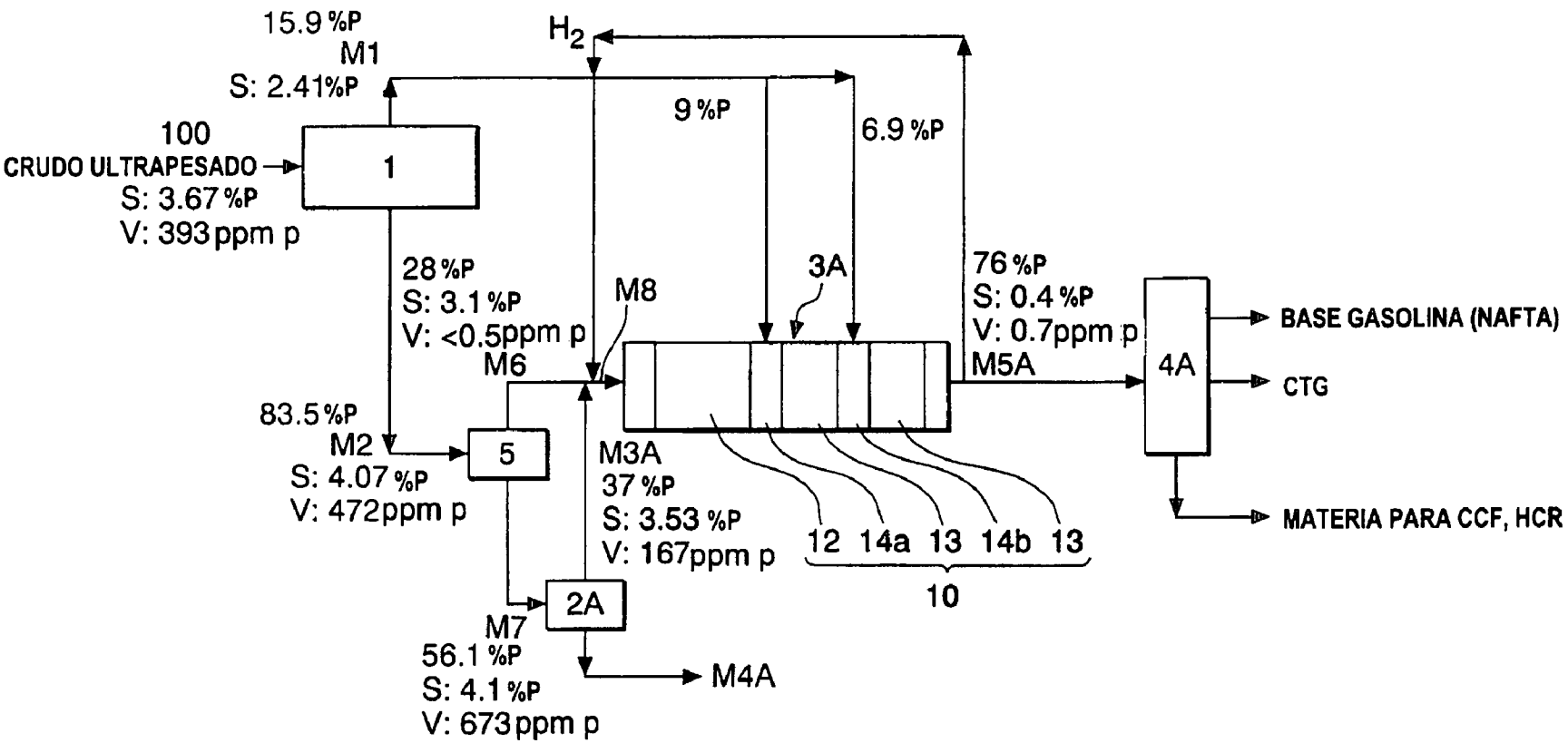
FIG. 7 is a flowchart showing the second embodiment of the refining method for oil according to the present invention.

Based on the refining method for oil shown in FIG. 2, like example 1, naphtha (gasoline component), GTF (gas turbine fuel), and feedstock for fluid catalytic cracking (FCC) or feedstock for hydrocracking (HCR) were produced as shown in FIG. 7.

A feed oil identical to that used in Example 1 was used, and the distillate oil M1 and the bottom oil M2 were obtained by a distillation step 1 identical to that in Example 1. The bottom oil 2 was further guided to a vacuum distillation apparatus and processed in a second distillation step 5 to obtain the vacuum gas oil M6 and the vacuum bottom oil M7. The yield of the vacuum gas oil M6 from the crude oil was 28 wt %, the sulfur concentration was 3.1 wt %, and the vanadium concentration was less than 0.5 wtppm. The yield of the vacuum bottom oil M7 from the crude oil was 56.1 wt %, the sulfur concentration was 4.1 wt %, and the vanadium concentration was 673 wtppm.

The vacuum bottom oil 7 was guided to the solvent deasphalting apparatus and the deasphalted oil M3A was obtained at a 66% extraction rate, and at the same time, asphaltene M4A, which is the residue, was obtained. The yield of the deasphalted oil M3A from the crude oil was 37%, the sulfur concentration was 3.53%, and the vanadium concentration was 167 wtppm.

The deasphalted oil M3A and the vacuum gas oil M6 were mixed and introduced into the hydrorefining reactor, and under conditions identical to those of Example 1, subject to a HDM and subject to a HDS process with the distillate oil M1, which serves as a quenching oil. The yield of the obtained processed oil M5A from the crude oil was 76%, the sulfur concentration was 0.32 wt %, and the vanadium concentration was 0.56 wtppm.

The processed oil M5A was subjected to the rectification process (rectification step 4) by Method 1, like Example 1, and Method 2. The obtained results are as follows.

TABLE 3

(rectification process: Method 1)

| | Yield from crude oil(wt %) | S (wt %) | V (wtppm) |
|---|---|---|---|
| Naphtha fraction | 2 | — | — |
| GTF | 13 | 0.02 | 0 |
| FCC feedstock or HCR feedstock | 61 | 0.4 | 0.7 |

TABLE 4

(rectification process: Method 2)

| | Yield from crude oil(wt %) | S (wt %) | V (wtppm) |
|---|---|---|---|
| Naphtha fraction | 2 | — | — |
| GTF | 26 | 0.21 | 0.35 |
| FCC feedstock or HCR feedstock | 48 | 0.4 | 0.7 |

As shown above, by using the vacuum distillation apparatus, the amount of processing by the solvent deasphalting apparatus decreases, and furthermore, compared to the solvent deasphalting a process of the atmospheric bottom oil, the extraction selectivity with respect to metals such as vanadium improves.

The above results confirm that according to the refining method of the present invention, pluralities of oil products can be produced together so as to satisfy their respective specifications.

Moreover, in this example, the vacuum gas oil was guided from the first HDM column, but because the metal concentration is extremely low, the same effect can be attained even if a part or all of the vacuum gas oil is guided to the second column along with the quenching oil.

In the refining method for oil of the present invention, when the components remaining after removing the residue from the feed oil are subjected to hydrorefining, the feed oil is fractionally distilled into distillate oil and bottom oil, and the bottom oil obtained by fractional distillation is separated into bottom light oil and residue, the bottom light oil is subject to a hydrogenation process by passing through the first catalyst layer, a mixture comprising the hydrogenation processed bottom light oil having distillate oil added thereto passes through a downstream catalyst layer, and is subject to a hydrogenation process. Thus, the temperature of this mixture is raised due to the heat generated during the hydrogenation process in the first catalyst layer, and the distillate oil is added, for example, as a quenching oil, to the bottom light oil whose temperature has increased, and thereby simple process structure becomes possible in comparison to the structure of a coker process that requires diene hydrogenation and HDS steps for the hydrogenation thermally cracked oil, and thereby, the structure for implementing the hydrorefining process can be simplified.

In addition, in the refining facility for oil according to the present invention, the distillate oil and bottom light oil, which are oils obtained by removing the residue from the crude oil, can be processed by one hydrorefining facility, the apparatus as a whole is simplified, and the facility cost is reduced.

What is claimed is:

1. A refining method for oil in which a feed oil is subject to a refining process, comprising:

a distillation step in which the feed oil is separated into a distillate oil and a bottom oil by distillation;

a separation step in which the bottom oil is separated into a bottom light oil and a residue by a method including solvent deasphalting (SDA); and a hydrorefining step in which the distillate oil and the bottom light oil are subjected to hydrorefining in the presence of hydrogen using a hydrogenation process unit provided with first and downstream catalyst layers filled with hydrorefining catalysts; and wherein the hydrorefining step comprises a hydrodemetalizing (HDM) step in which an oil passes through the first catalyst layer having a HDM capacity to undergo mainly a HDM process, and a hydrodesulfurizing (HDS) step in which an oil passes through the downstream catalyst layer having a HDS capacity to undergo mainly a HDS process, in the hydrorefining step, the bottom light oil passes through the first catalyst layer of a hydrogenation process unit to undergo the hydrodemetalizing (HDM) step, the distillate oil obtained by the distillation step is added to the bottom light oil that has passed through the first catalyst to cool the bottom light oil and to produce a mixed oil, and the mixed oil passes through the downstream catalyst layer to be subject to the hydrodesulfurizing (HDS) step.

2. A refining method according to claim 1, wherein the separation step that separates the bottom oil into a bottom light oil and a residue is a solvent deasphalting (SDA) step in which the bottom oil is subjected to solvent deasphalting to obtain a deasphalted oil (DAO), which is a bottom light oil, and asphaltene, which is a residue.

3. A refining method for oil in which a feed oil is subject to a refining process comprising:

a first distillation step in which a feed oil is separated into a first distillate oil and a first bottom oil by distillation;

a second distillation step in which the first bottom oil is separated into a second distillate oil and a second bottom oil under a pressure lower than that of the fist distillation step;

a solvent deasphalting (SDA) step in which the second bottom oil is separated into a deasphalted oil (DAO) and asphaltene, which is a residue, by solvent deasphalting; and a hydrorefining step in which the first distillate oil the second distillate oil, and the DAO are subjected to hydrorefining in the presence of hydrogen using a hydrogenation process unit provided with first and downstream catalyst layers filled with a hydrorefining catalyst, and wherein the hydrorefining step comprises a hydrodemetalizing (HDM) step in which an oil passes through the first catalyst layer having a HDM capacity to undergo mainly a HDM process, and a hydrodesulfurizing (HDS) step in which an oil passes through the downstream catalyst layer having a HDS capacity to undergo mainly a HDS process, in the hydrorefining step, the second distillate oil and the DAO are mixed and subjected to the hydrodemetalizing (HDM) step by being passed through the first catalyst layer of the hydrorefining unit to produce a bottom light oil, the first distillate oil obtained by the first distillation step is added to the bottom light oil that has passed through the first catalyst to cool the bottom light oil and to produce a mixed oil, and the mixed oil is passed through the downstream catalyst layer to undergo the hydrodesulfurizing (HDS) step.

4. A refining method for oil that produces oil products by subjecting a feed oil to a refining process, comprising:

a distillation step in which the feed oil is separated into a distillate oil and a bottom oil by distillation;

a separation step in which the bottom oil is separated into a bottom light oil and a residue by a method including solvent deasphalting (SDA);

a hydrorefining step in which the distillate oil and the bottom light oil are subjected to hydrorefining in the presence of hydrogen using a hydrogenation process unit provided with first and downstream catalyst layers filled with a hydrorefining catalyst; and a rectification step in which the processed oil obtained by the hydrorefining step is fractionally rectified into oil products; and wherein the hydrorefining step comprises a hydrodemetalizing (HDM) step in which an oil passes through the first catalyst layer having a HDM capacity to undergo mainly a HDM process, and a hydrodesulfurizing (HDS) step in which an oil passes through the downstream catalyst layer having a HDS capacity to undergo mainly a HDS process, in the hydrorefining step, the bottom light oil passes through the first catalyst layer of a hydrogenation process unit to undergo the hydrodemetalizing (HDM) step, the distillate oil obtained by the distillation step is added to the bottom light oil that has passed through the first catalyst to cool the bottom light oil and to produce a mixed oil, and the mixed oil passes through the downstream catalyst layer to be subject to the hydrodesulfurizing (HDS) step.

5. A refining method for oil according to claim 1, wherein the API gravity of the feed oil is equal to or less than 20.

6. A refining method for oil according to claim 1, wherein the heavy oil that is used as the feed oil has a quantity of gas oil and oil lighter than gas oil that is equal to or less than 30 wt % of the total.

7. A refining method for oil according to claim 1, wherein the processing conditions in the hydrorefining step have a hydrogen partial pressure of 60 to 200 $kg/cm^2$, a hydrogen to oil ratio of 200 to 1000 $Nm^3/kl$, a temperature of 350 to 450° C., and a capacity ratio of the HDM catalyst to the HDS catalyst of 5/95 to 40/60.

8. A refining method for oil according to claim 4, wherein the oil products obtained by the rectification in the rectification process are at least one of gasoline component, kerosene, bottom light oil, gas turbine fuel, a feedstock for fluid catalytic cracking, and a feedstock for hydrocracking.

9. A refining method for oil according to claim 4, wherein the oil products obtained by rectification in the rectification process are a gasoline component arid a gas turbine fuel.

10. A refining facility for oil in which a feed oil is subject to a refining process comprising:

a distillation unit in which the feed oil is separated by distillation into a distillate oil and a bottom oil;

a separation unit in which the bottom oil is separated into bottom light oil arid a residue by a method including solvent deasphalting (SDA); and a hydrorefining unit in which the distillate oil arid bottom light oil are subjected to hydrorefining in the presence of hydrogen; and wherein the hydrorefining unit possesses a hydrodemetalizing (HDM) catalyst layer that mainly carries out HDM by being filled with a catalyst that has a HDM capacity, and a hvdrodesulfurizing (HDS) catalyst layer that mainly carries out HDS by being filled with a catalyst having a HDS capacity, a quenching zone provided between these catalyst layers to which a part of the distillate oil is supplied as a quenching material, a first feed pipe for supplying the bottom light oil obtained by the separation unit to the HDM catalyst layer, and a second feed pipe for supplying the distillate oil to the quenching zone so that the bottom light oil that has passed through the HDM catalyst is cooled by the distillate oil arid a mixture of the bottom light oil and the distillate oil passes through the HDS catalyst layer.

11. A refining facility according to claim 10, wherein the separation unit that separates the bottom oil into bottom light oil and a residue is a solvent deasphalting (SDA) unit which subjects the bottom oil to solvent deasphalting to obtain a deasphalted oil (DAO), which is a bottom light oil, and asphaltene, which is a residue.

12. A refining facility according to claim 10, wherein the separation unit that separates the bottom oil into a bottom light oil and a residue comprises a second distillation unit that separates the bottom oil into a second distillate oil and a second bottom oil at a pressure lower than the upstream distillation unit, and a solvent deasphalting (SDA) unit that separates the second bottom oil obtained by the second distillation unit into a deasphalted oil (DAO), which is a bottom light oil, and asphaltene, which is a residue, by solvent deasphalting.

* * * * *

UNITED STATES PATENT AND TRADEMARK OFFICE

CERTIFICATE OF CORRECTION

PATENT NO. : 7,361,266 B2
APPLICATION NO. : 10/507565
DATED : April 22, 2008
INVENTOR(S) : Makoto Inomata et al.

It is certified that error appears in the above-identified patent and that said Letters Patent is hereby corrected as shown below:

Title Page and Col. 1:

Please delete "METHOD OF REFINING PETROLEUM AND REFINING APPARATUS" and insert --METHOD AND FACILITY FOR REFINING OIL--

Signed and Sealed this

Eighth Day of July, 2008

JON W. DUDAS
*Director of the United States Patent and Trademark Office*